US009121140B2

(12) United States Patent
Conner, Jr.

(10) Patent No.: US 9,121,140 B2
(45) Date of Patent: Sep. 1, 2015

(54) LOW PROFILE MATERIAL HANDLING SYSTEM

(76) Inventor: Robert B. Conner, Jr., Pulaski, VA (US)

( * ) Notice: Subject to any disclaimer, the term of this patent is extended or adjusted under 35 U.S.C. 154(b) by 785 days.

(21) Appl. No.: 13/370,296

(22) Filed: Feb. 9, 2012

(65) Prior Publication Data

US 2012/0201635 A1 Aug. 9, 2012

Related U.S. Application Data

(60) Provisional application No. 61/440,953, filed on Feb. 9, 2011.

(51) Int. Cl.

| | |
|---|---|
| ***B65G 67/00*** | (2006.01) |
| ***E01B 29/16*** | (2006.01) |
| ***E01B 23/02*** | (2006.01) |
| *B61D 47/00* | (2006.01) |

(52) U.S. Cl.

CPC ..... *E01B 29/16* (2013.01); *E01B 23/02* (2013.01); *B61D 47/00* (2013.01)

(58) Field of Classification Search

CPC ..... B61D 47/00; B61D 47/005; B61D 15/00; E01B 27/02; E01B 29/17; E01B 29/16; E01B 23/02; B66C 23/36

USPC ..... 414/339; 171/16; 180/7.5; 104/2, 3, 4, 104/5, 6, 7.1, 7.2, 12, 307; 105/13, 364, 105/365, 393; 212/224, 327, 306

See application file for complete search history.

(56) References Cited

U.S. PATENT DOCUMENTS

| | | | | |
|---|---|---|---|---|
| 315,034 | A | | 4/1885 | Holman |
| 735,005 | A | | 7/1903 | Ware |
| 1,000,431 | A | * | 8/1911 | Morgan ..... 104/5 |
| 1,255,193 | A | | 2/1918 | Madden et al. |
| 1,528,529 | A | | 3/1925 | Chicoine et al. |
| 2,077,738 | A | * | 4/1937 | Breaker ..... 104/2 |
| 2,671,414 | A | | 3/1954 | Moe |
| 3,212,451 | A | * | 10/1965 | Doorley et al. ..... 104/7.1 |
| 3,465,687 | A | | 9/1969 | Kerns |
| 3,521,565 | A | | 7/1970 | Plasser et al. |
| 3,635,164 | A | | 1/1972 | Patton |
| 3,654,868 | A | | 4/1972 | Plasser et al. |
| 3,731,635 | A | | 5/1973 | Hambrick |
| 3,972,292 | A | | 8/1976 | Theurer |
| 4,000,699 | A | | 1/1977 | Scheuchzer et al. |
| 4,004,524 | A | | 1/1977 | Scheuchzer et al. |
| 4,046,077 | A | | 9/1977 | Theurer et al. |

(Continued)

*Primary Examiner* — Saul Rodriguez
*Assistant Examiner* — Glenn Myers
(74) *Attorney, Agent, or Firm* — Brian W. Foxworthy; Robert R. Waters; Waters Law Group, PLLC

(57) ABSTRACT

A material handling system has a shuttle car attached by an extension element either directly to a supply car or to a staging car attached to a supply car. An object manipulator moves an object into place for acquisition by the shuttle car which is brought into position by retraction of the extension element. The extension element extends and moves the shuttle car away to draw the object most of the way from the staging car. A second object manipulator opposite to the shuttle engages the object before the object is pulled completely from the supply car. The shuttle car and the second manipulator lower the object. Objects may also be retrieved and placed on the supply car. In some embodiments, a track on the staging and supply cars may allow a manipulator to travel along the cars to acquire objects.

24 Claims, 12 Drawing Sheets

(56) References Cited

U.S. PATENT DOCUMENTS

| | | | | |
|---|---|---|---|---|
| 4,094,249 | A | 6/1978 | Theurer et al. | |
| 4,152,989 | A | 5/1979 | Theurer et al. | |
| 4,160,418 | A | 7/1979 | Theurer et al. | |
| 4,236,452 | A | 12/1980 | Theurer et al. | |
| 4,261,264 | A | 4/1981 | Theurer et al. | |
| 4,270,456 | A | 6/1981 | Theurer et al. | |
| 4,502,389 | A * | 3/1985 | Theurer et al. | 104/2 |
| 4,542,697 | A | 9/1985 | Cicin-Sain | |
| 4,571,825 | A | 2/1986 | Skibsted | |
| 5,297,482 | A * | 3/1994 | Cleveland | 104/7.2 |
| 5,337,675 | A | 8/1994 | Aubermann | |
| 5,357,867 | A | 10/1994 | Theurer et al. | |
| 5,590,601 | A * | 1/1997 | Theurer et al. | 104/2 |
| 6,089,161 | A | 7/2000 | Saban | |
| 6,352,400 | B1 * | 3/2002 | Forbes | 414/339 |
| 6,375,402 | B1 | 4/2002 | Hertelendi et al. | |
| 6,637,727 | B1 | 10/2003 | Decker et al. | |
| 7,516,702 | B2 * | 4/2009 | Theurer et al. | 104/2 |
| 2004/0178045 | A1 * | 9/2004 | Conner, Jr. | 198/313 |
| 2007/0022898 | A1 * | 2/2007 | Theurer et al. | 104/2 |

* cited by examiner

LOW PROFILE MATERIAL HANDLING SYSTEM

CROSS REFERENCE TO RELATED APPLICATIONS

This application claims priority from U.S. Provisional Application 61/440,953, filed on Feb. 9, 2011. The teachings in the specification and drawings for U.S. Provisional Application 61/440,953 are incorporated herein by reference.

FIELD OF THE INVENTION

This invention relates generally to material handling. More specifically, this invention relates to a system particularly suited for material handling for long objects such as rails in low profile environments such as mines.

BACKGROUND OF THE INVENTION

Mines frequently require low profile equipment and operations. To remove large quantities of materials, mines often utilize track systems that are very similar to track systems found above ground for railroads. These track systems have long steel rails laid end to end and in parallel with the parallel set of rails connected by a series of cross ties to form the rail tracks. The cross ties are usually wood, but can be of other material as well. Cars run on these track systems to remove mine material from the mine as well as to move equipment about the mine. While the track systems are very useful, the steel rails are quite heavy and installing the track systems in the restrictive confines of the mine can be extremely labor intensive as well as dangerous. The installation of the track systems requires manual handling of the steel rails, and because of their length and weight, this is extremely difficult work. The weight of the rails can lead to injuries just from moving the rails, let alone should control of the rail be lost and a person be trapped, or pinched, in some manner by the rail. Other elongated materials such as pipes, roof supports, and conduits are also moved in and out of mines. The several embodiments of the instant invention address issues of manual loading and unloading of heavy objects in confined environments.

DESCRIPTION OF RELEVANT ART

U.S. Pat. No. 4,571,825 by Skibsted is for a "Railroad track removing apparatus". The invention of Skibsted provides an apparatus for removing railroad track, comprising an elongated frame arranged to straddle a pair of rails and having elongated skids arranged to sit upon and slide along the ends of ties secured to the rails on the outboard sides of the rails, a rail and tie separating assembly mounted on the frame for separating lengths of rail from the ties to which the lengths of rail are secured, a rail elevating assembly for lifting lengths of rail which has been separated by the rail and tie separating assembly, and a conveyor for receiving a length of rail lifted by the elevating assembly and longitudinally transporting the rail to one end of the frame.

U.S. Pat. No. 1,255,193 by Madden et al. is for a "Rail Layer". Madden provides a frame that is at least partially adapted to roll on rails. A part of the frame extends out over the side of the tracks and a hoist can ride out over the extended part of the frame to overhang outside the track where the hoist can pick up rails and carry them to the side of the track. The hoist picks up rails that have already been positioned near the track.

U.S. Pat. No. 2,671,414 by Moe is for a "Rail Re-Layer". Moe is similar to Madden but provides an onboard power source to power a hoist as well as to propel the Rail Re-Layer. The Rail Re-Layer has an endless track that is positioned in the bed of the rail track and the onboard power source drives the endless track to move the Rail Re-Layer. In some applications, the Rail Re-Layer has a wheel associated with the endless track that can ride on a rail. In those applications, that wheel is driven and that is what moves the Rail Re-Layer.

U.S. Pat. No. 6,375,402 by Hertelendi et al. is for an "Apparatus for Unloading Rails". An apparatus for unloading rails from a freight car on which the rails are arrayed to extend in a longitudinal direction of the freight car comprises a track-bound car, and a rail guiding unit positioned at each car end. Each rail guiding unit comprises a pair of rail guide heads having guide rollers for centering a respective one of the rails therebetween. The rail guide heads of a first rail guiding unit are positioned at one of the car ends and are displaceable in a horizontal plane perpendicularly to the longitudinal direction, and drives are provided for vertically adjusting the rail guide heads of the first rail guiding unit.

As may be seen from review of the above prior art, the prior art is not adapted to work in low profile environments such as mines like the several embodiments of the present invention. That and other advantages of embodiments of the present invention will be understood in light of the following descriptions of embodiments. While several embodiments are described, these are not the only embodiments within the scope of this invention and the described embodiments should not be considered as limiting the scope of the application.

SUMMARY OF THE INVENTION

Before discussing embodiments of the invention in summary or detail, a note is made to avoid confusion for those already familiar with mining. The term "shuttle car" is often used in mining for cars that move coal or other mined material from its extraction point to a conveyor which moves the material out of the mine. In this application and in the following description, the term "shuttle car" does not have that meaning Rather, "shuttle car" is applied to an element of embodiments of the invention which moves back and forth to shift the position of objects being loaded or unloaded.

Flat cars are used to transport the steel rails for mine track systems and other objects in mines. Elements of the system attach to the flat car, or supply car, for unloading and loading objects, such as steel rails, within the mine. A shuttle car has one end of an extension element attached to it. The other end of the extension element attaches to the supply car or a staging car intervening between the shuttle car and the supply car. The extension element moves the shuttle car back and forth with respect to the supply car by extending and retracting. To unload an object, such as a rail, the shuttle car is brought into proximity to the supply car by retraction of the extension element, and the near end of the object is engaged to the shuttle car. The extension element then extends to move the shuttle car away from the supply car to draw the object from the supply car. Once the elongated object is drawn to length, it is lowered to the track bed. At both ends of the object, a lowering mechanism is employed to lower it. For the end at the shuttle car, the entire shuttle car may lower itself in order lower the object. For the end near the supply car, an additional lowering mechanism is employed to lower the object. To load an object when objects, such as rails, are being retrieved, the process is reversed.

In at least one embodiment of the system, the system is capable of detecting when a free end of an object has too nearly approached the front end of the supply car or staging car. This allows the system to shut down to prevent the free end of an object from being pulled off of the supply car or staging car and falling, possibly injuring a person, or causing other, less serious, damage. In one embodiment, a hinged plate is located at the leading edge of the last supporting surface and a switch is associated with the hinged plate. When the switch detects that the hinged plate has become loaded, the advance of the shuttle car is halted, so that the object is not pulled off of the supporting car. A lowering mechanism can then be employed to lower that end of the object, once the system is restarted. Other detection mechanisms may be employed in other embodiments.

Some embodiments may employ a manipulator to move objects about on the supply car so that the objects are properly positioned for engagement by the shuttle car. This manipulator may be mounted on the supply car, or in embodiments employing a staging car, the manipulator may be mounted on the staging car. In still other embodiments, the manipulator may be capable of traveling along the supply car or staging car and may even be transferable between the supply car and the staging car. This can be accomplished, for example, by mounting the manipulator to a rail or conveyor system. When a supply car and staging car are used, if the rail or conveyor system traverses the two cars, then the manipulator can travel between the two cars. In embodiments where the manipulator is capable of travel, the end of the extension element opposite to the shuttle car may also travel with respect to the supply car or staging car. For example, that end of the extension element may also travel along a track and may even attach to the manipulator. This would allow the back and forth motion of the manipulator and shuttle car to be synchronized.

One type of a rail manipulator is a crane. A crane can attach to the objects and lift or pull the objects to manipulate them into position to be engaged by the shuttle car, or to receive the objects from the shuttle car and store them on the supply car. In embodiments employing a staging car, the crane can position the objects on the staging cars. The crane can also function as the lowering mechanism and lower or raise the ends of objects opposite to the shuttle car. Another, perhaps simpler object manipulator, would be a winch. If the winch is located on the staging car or supply car, the winch can pull objects to desired locations for attachment to the shuttle car. As with a crane, a winch may also function as a lowering mechanism. Some embodiments, however, may locate a winch as an object manipulator on the shuttle car itself. In those embodiments, the cable of the winch can be engaged to an object, such as a rail, and the winch can pull the object to the shuttle car. When the shuttle car is already separated a distance from an associated staging car or supply car by an extension element, the use of a winch located on the shuttle car can reduce the distance that a shuttle car needs to travel to draw an object off of the associated car.

The supply car and the staging car have wheels adapted to roll on the steel rails of the track system. However, the shuttle car has wheels on it which are intended to roll on the ground or floor of a mine shaft. If the system is being used to install a track system, the supply car and staging car will roll on rails that have already been laid. If the system is being used to take up a track system, the supply car and staging car will roll on rails that have not yet been retrieved. The shuttle car has a steering mechanism which allows it to be directed when it is being moved back and forth with respect to the supply car.

When the material handling system is being used to handle long objects, such as railing for example, a steel rail lying on the supply car is moved forward to a position where it can be engaged by the shuttle car. In embodiments employing a manipulator, the manipulator is used to move the rail. In embodiments employing a staging car, at least part of the rail will be placed on the staging car. The rail is then engaged by the shuttle car and the extension element, which has been retracted to bring the shuttle car into position, is extended to move the shuttle car away from the supply car to draw the rail out most of its length. Some embodiments are equipped with an emergency stop which detects if the free end of the rail is approaching the edge of its last support and stops the progress of the shuttle car to prevent the rail from being pulled off of its support.

The end of the object still on the supply car or staging car can be engaged by a lowering mechanism, if need be, and both ends are lowered to the floor of the mine; one end by the shuttle car and the other end by the lowering mechanism. Some embodiments do not required specific engagement of the rail by a lowering mechanism. For example, one lowering mechanism consists of a cross bar at the edge of the supply car or staging car that rises up and down. When the rail is drawn to length, its trailing end is brought to rest on the crossbar. Other embodiments may utilize a lowering mechanism such as a crane to lower the trailing end of the rail to the floor of the mine. In that case, the cable of the crane has to be attached to the rail to lower that end of the rail. To allow the carriage of the shuttle car to have contact with the selected rail, the telescoping boom of the shuttle car is in its retracted state which brings the carriage of the shuttle car into position next to the crane car. There the shuttle car can be coupled to the steel rail.

In at least one embodiment, the shuttle car lowers itself to lower its end of the object to the mine floor. To accomplish this, one embodiment of the shuttle car has two wheels. Each wheel is at the end of pivoting arms which pivot about points on the shuttle car. To lower the shuttle car, the pivoting arms rotate upward, allowing the shuttle car to settle. To lift the shuttle car the pivoting arms rotate downward, which drives the shuttle car upward.

The distance of travel by the shuttle car is determined by the maximum extension capabilities of the extension element. If the extension element is capable of extending the full length of a rail, typically 30 feet, then a rail may be completely drawn from the supply car or staging car by a single extension of the extension element. However, if the extension elements capabilities are less than the length of the rail, then the shuttle car needs to draw a rail partially off the rail or staging car, disengage the rail, return to nearer the supply or staging car, reengage the rail, and extend to finish drawing the rail from the supply or staging car. The rail can then be lowered, as previously described. Objects of other lengths will affect the operation of the material handling system similarly.

DETAILED DESCRIPTIONS OF THE EMBODIMENTS

Figure 1:
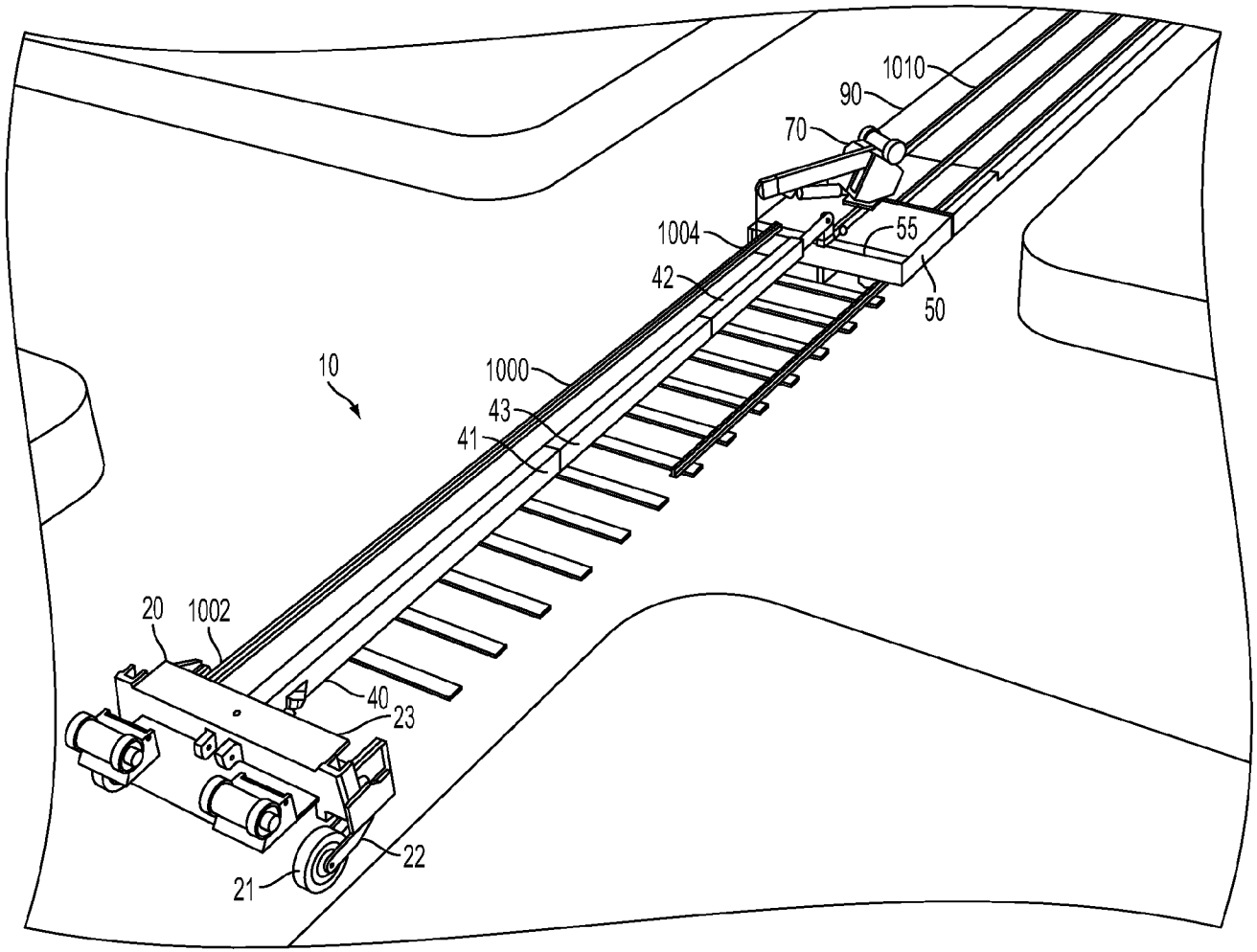
FIG. 1 is a perspective view of an embodiment of the material handling system.

FIG. 1 is a perspective view of an embodiment of the material handling system. In FIG. 1, material handling system 10 is shown in the process of loading or unloading a section of rail 1000. Shuttle car 20 is attached to staging car 50 by extension element 40. Staging car 50 is attached to supply car 90 which carries a supply of rails 1010. In the embodiment shown in FIG. 1, extension element 40 is a telescoping boom with three nested sections: a distal end, or section, 41 that attaches to shuttle car 20; a proximal end, or section, 42 that attaches to staging car 50; and a middle section 43 spanning between distal end 41 and proximal end 42. In the embodiment of material handling system 10 in FIG. 1, the majority of the back and forth motion of shuttle car 20 is created by the telescoping action of extension element 40.

In FIG. 1, each end of rail 1000 is supported by material handling system 10. In this specification, the end of rail 1000 that is extended furthest from supply car 90 will be referred to as extended end 1002 of rail 1000 and the end of rail 1000 that maintains closer proximity to supply car 90 will be referred to as proximal end 1004 of rail 1000. In FIG. 1, extended end 1002 of rail 1000 is supported by shuttle car 20, while proximal end 1004 is supported by crane 70 located on staging car 50. Crane 70 operates as a lowering mechanism to lower proximal end 1004 of rail 1000. Similarly, shuttle car 20 operates as a lowering mechanism to lower extended end 1002 of rail 1000. Rails for track systems typically have apertures or other features at their ends so that they can be aligned with and attached to neighboring rails. These features can be used by shuttle car 20 and an object manipulator or lowering mechanism to engage the rails. Alternatively, the shuttle car, object manipulator, and lowering mechanism can engage the rails by their grosser features as well. Similarly, when material handling system 10 is being used with other objects, features on those objects can be used to engage the objects. For high volume work, it may be worthwhile developing specialized grapples. Alternatively generic grapples may wrap around a feature of an object.

Figure 2:
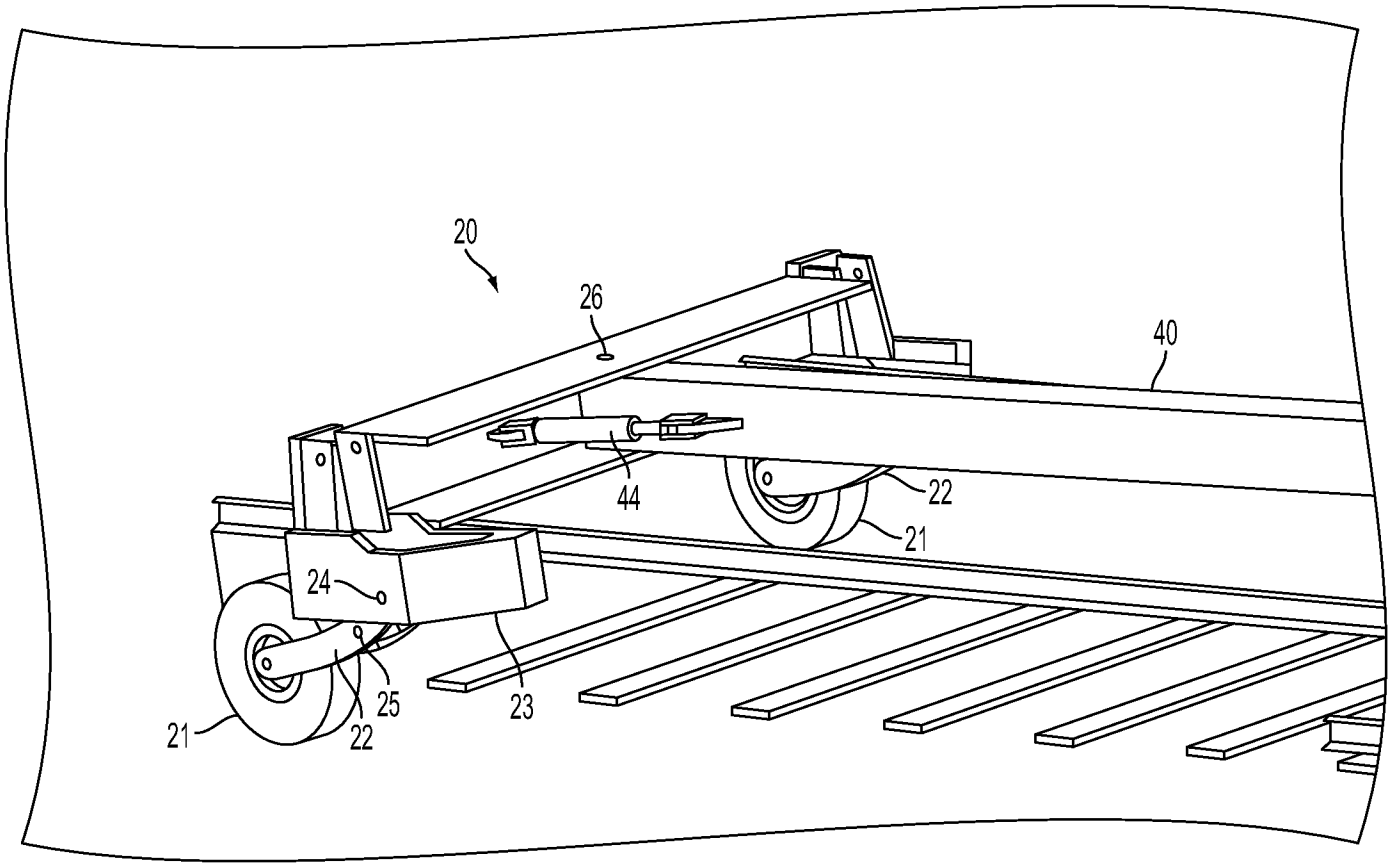
FIG. 2 is a perspective view of an embodiment of a shuttle car.

Referring now to FIG. 2 as well as to FIG. 1, several elements of shuttle car 20 may be seen. Wheels 21 of shuttle car 20 are constructed to roll on ground surfaces and mine shaft floors and are mounted at the ends of swing arms 22. Swing arms 22 are themselves mounted to the frame 23 of shuttle car 20 at frame pivots 24. Swings arms 22 raise and lower shuttle car 20 and extended end 1002 of rail 1000 along with it. When swing arms 22 rotate downward, shuttle car 20 is lifted. When swing arms 22 rotate upward, shuttle car 20 is allowed to lower toward the mine floor. In some embodiments, swing arms 22 are actuated by power cylinders connected to drive pivots 25 (power cylinders are not shown in the figures).

Shuttle car 20 can be steered as it is moved back and forth from supply car 90. Extension element 40 is pivotally connected at steering pivot 26 to frame 23 of shuttle car 20. The pivot connection at steering pivot 26 allows the angle of shuttle car 20 with respect to extension element 40 to change. Steering cylinder 44 is pivotally connected at one of its ends to the side of extension element 40 and at its other end to frame 23 of shuttle car 20. Varying the length of steering cylinder 44, varies the angle of shuttle car 20 with respect to extension element 40. By varying the angle of shuttle car 20 as it is extended or retracted, its direction can be affected.

Figure 3:
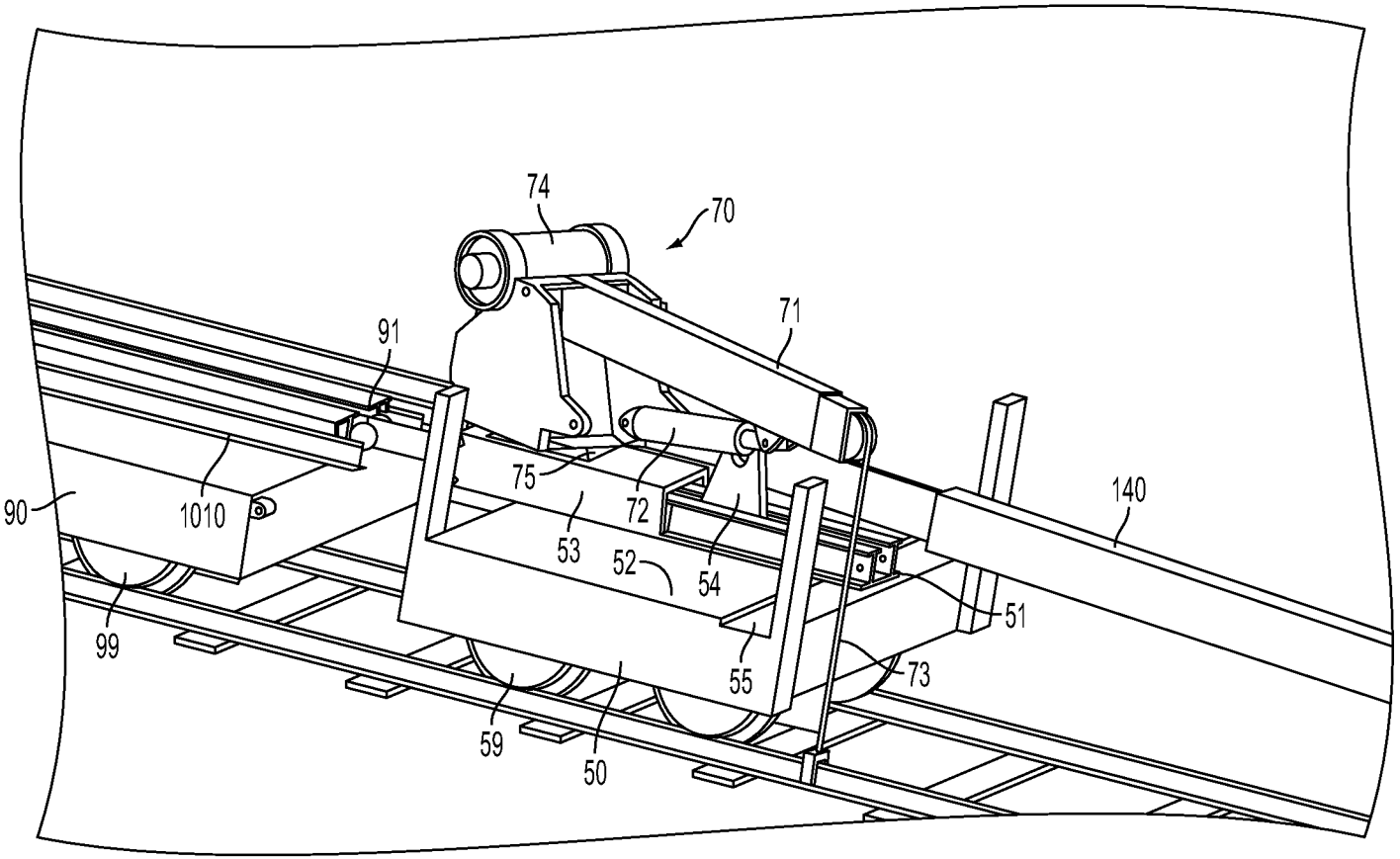
FIG. 3 is a perspective view of an embodiment of a staging car attached to an embodiment of a supply car.

FIG. 3 is a perspective view of an embodiment of a staging car 50 attached to an embodiment of a supply car 90. The wheels 59 and 99 on staging car 50 and supply car 90, respectively, are standard wheels for riding on rails, as those cars will be able to stay on anchored rails which have already been laid or have not yet been retrieved, depending on the situation. Staging car 50 has a track 51 on its top surface 52. Trolley 53 rides on track 51 and carries an object manipulator, in this case, crane 70. Crane 70 is used to manipulate rails 1010 and stage them for engagement by shuttle car 20. Crane 70 may also be used as a lowering mechanism to lower the proximal end of a rail. Other embodiments of material handling system 10 may employ a winch as an object manipulator or lowering mechanism or both.

Track 51 on staging car 50 aligns with, and is complementary to, track 91 on supply car 90 which allows trolley 53 to pass back and forth between staging car 50 and supply car 90 where crane 70 can acquire rails 1010 to move them onto staging car 50. In the embodiment shown in FIG. 3, extension element 140 is a straight, elongated member which attaches to extension mount 54 on trolley 53. In this embodiment, the back and forth motion of shuttle car 20 is created by the movement of trolley 53 on tracks 51 and 91 being transmitted via straight extension element 140 to shuttle car 20. Connection of extension element 140 to trolley 53 allows the motion of extension element 140 and crane 70 to be synchronized.

Crane 70 has a boom 71, boom cylinder 72, cable 73, cable drum 74, and base 75 among other features. Boom cylinder 72 extends and retracts to raise and lower boom 71. Cable drum 74 lets out and takes in cable 73. The end of cable 73 is attached to a rail to engage it and manipulate its position. Crane 70 can swivel to either side of tracks 51 and 91, and when being used as a lowering mechanism, can be set up so that it can extend over the forward edge of staging car 50 so that it can lower its end of an object down to the mine floor.

Figure 5:
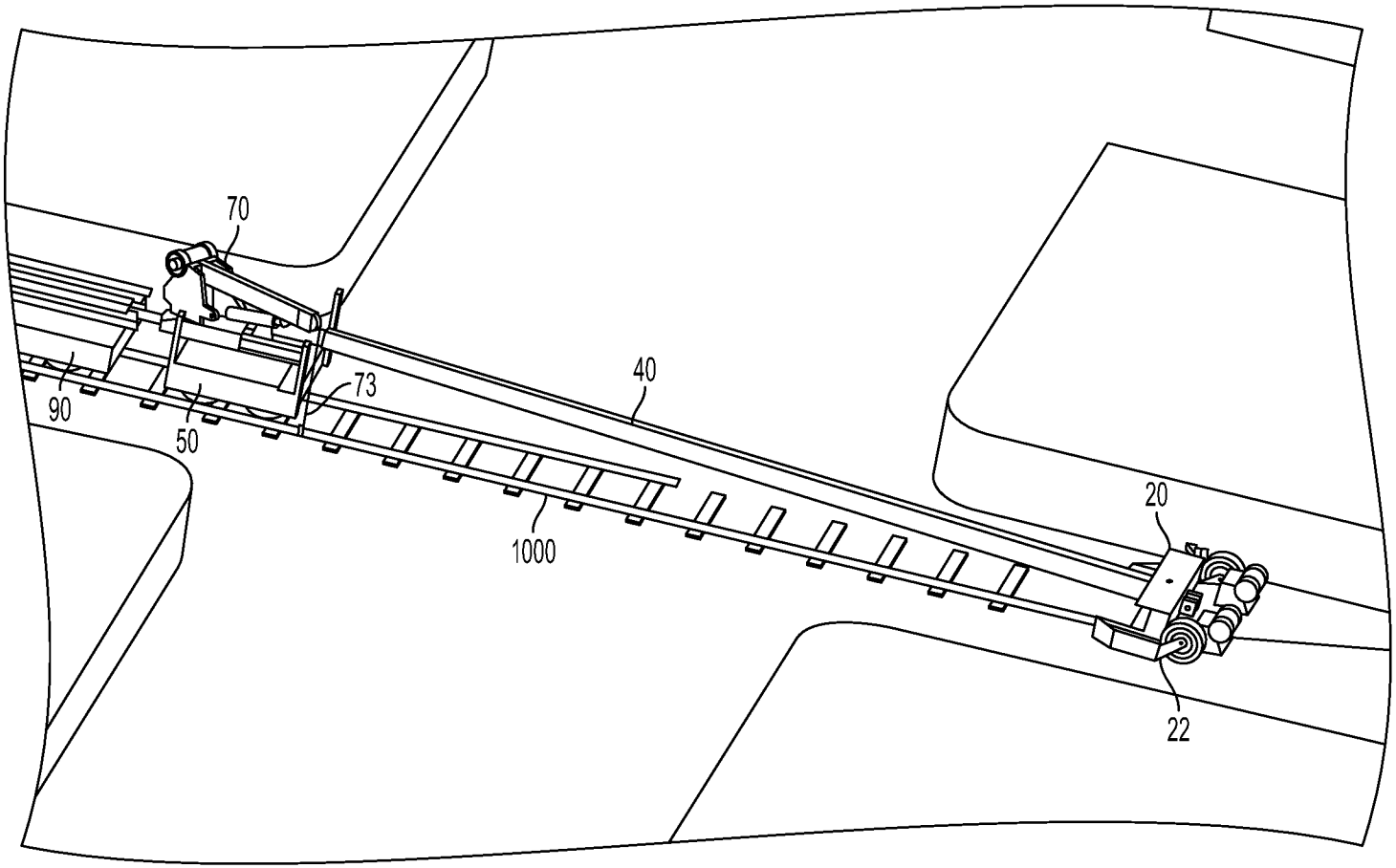
FIG. 5 is a perspective view of an embodiment of a material handling system in which a rail is on the mine floor.

It has been previously noted that a winch might also serve as a rail manipulator, or as a lowering mechanism, or both. Returning to FIG. 1, winches 27 are mounted on shuttle car 20 opposite to staging car 50 and supply car 90. Winches 27 and their respective cables can be used to draw objects, such as rails, to shuttle car 20 without shuttle car 20 being in close proximity to an associated staging car 50 or supply car 90. In those situations, shuttle car 20 would only need to be close enough that the center of mass of rail 1000 remains on the associated car until shuttle car 20 can give positive support to the extended end 1002 of rail 1000. If the center of mass of rail 1000 is drawn from an associated car without positive support of extended end 1002 of rail 1000, the flexible nature of a winch cable would allow extended end 1002 of rail 1000 to fall. Rail 1000 may also slide as that occurs. Regardless, the uncontrolled motion of rail 1000 would be dangerous. Hence, the limits on separation between shuttle car 20 and any associated cars when winch 27 is mounted on shuttle car 20 and used to pull rails 1000 to shuttle car 20. FIG. 5 also shows winches 27 mounted on shuttle car 20.

Figure 4:
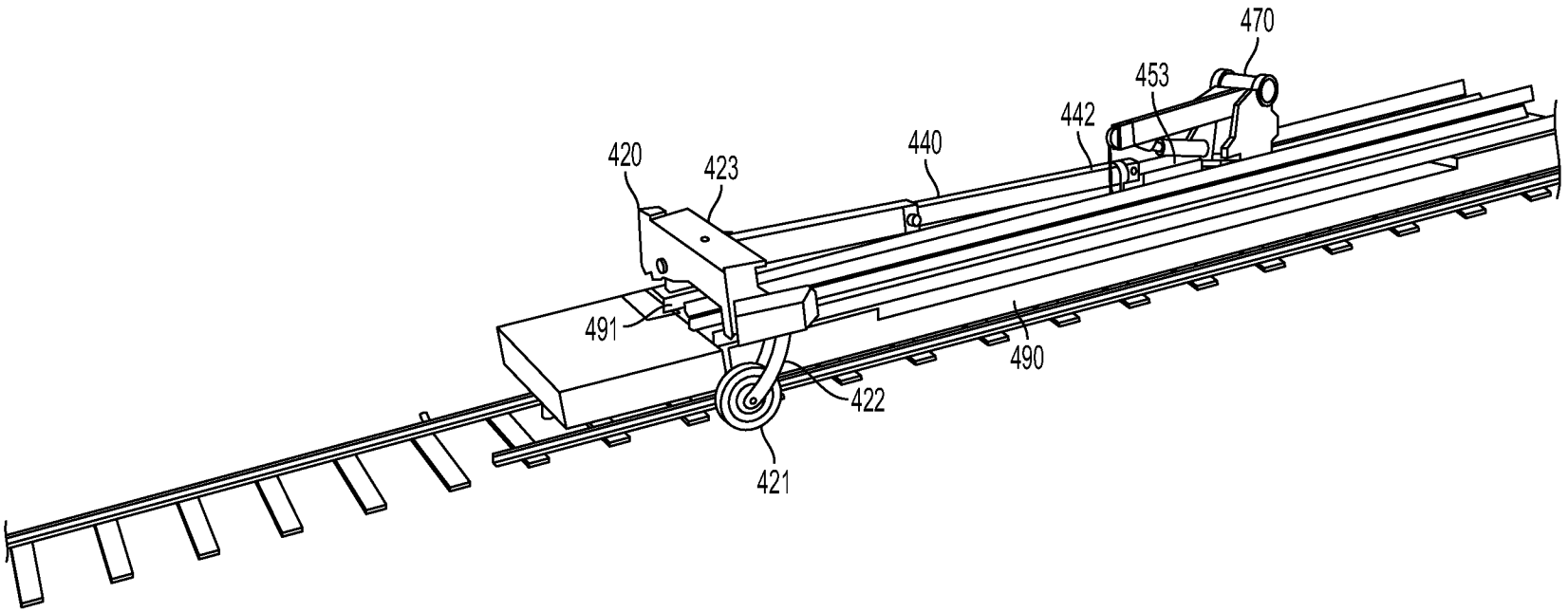
FIG. 4 is a perspective view of an embodiment of a material handling system in which the shuttle car can straddle the supply car.

In FIG. 4, at the exposed edge of staging car 50, is monitor plate 55 which serves as a safety zone. Monitor plate 55 has a sensor associated with it which detects when the proximal end 1004 of a rail 1000 is pulled onto monitor plate 55 during the rail unloading process. When the sensor detects that the proximal end 1004 of a rail 1000 is pulled onto monitor plate 55 and therefore has entered the safety zone, material handling system 10 stops the extension of shuttle car 20 to prevent proximal end 1004 of rail 1000 from being pulled from staging car 50 without having a lowering mechanism to support it. This prevents proximal end 1004 from freely falling to the mine floor, a major safety risk. Several types of sensors may be employed. For example, monitor plate 55 may be movably mounted such as by a hinge and supported by springs, and the sensor may detect the motion of monitor plate 55 when proximal end 1004 of rail 1000 moves onto plate 55 and puts plate 55 under load. Alternatively, the sensor may be a load cell that detects the additional load placed on plate 55. Some embodiments may employ a sensor that monitors the impedance associated with monitor plate 55 which would change when a rail made contact with plate 55. Other sensors may also be suitable.

FIG. 4 is a perspective view of an embodiment of a material handling system in which the shuttle car can straddle the supply car. In the embodiment of material handling system 10 of FIG. 4, wheels 421 of shuttle car 420 are mounted on swing arms 422 which are mounted to frame 423 of shuttle car 420. When swing arms 422 rotate downward, shuttle car 420 is lifted. In the embodiment of material handling system 10 of FIG. 4, swings arms 422 are capable of lifting shuttle car 420 high enough to clear the top of supply car 490. Wheels 421 and swing arms 422 are positioned wide enough that they can straddle supply car 490, allowing shuttle car 420 to be moved over supply car 490.

Similar to other embodiments of material handling system 10, the embodiment of FIG. 4 has a track 491 on its top surface with a trolley 453 riding on track 491. Trolley 453 carries crane 470 and the proximal end 442 of extension element 440 attaches to trolley 453. Extension element 440 of the embodiment of FIG. 4 is a telescoping boom and in that embodiment, the motion of shuttle car 420 is effected by both the motion of trolley 453 and the extension and retraction of telescoping extension element 440.

Once shuttle car 420 and crane 470 have engaged a rail, trolley 453 moves along track 491 to move crane 470 and shuttle car 420 and move the rail off of supply car 490. Once the rail is moved beyond supply car 490 and or staging car 450, to lower the rail to the mine floor, shuttle car 420 lowers itself to lower the rail and crane 470 lowers the rail using its boom or by paying out cable. In this embodiment, crane 470 acts as both an object manipulator and object lowering mechanism. Depending on the extension capabilities of telescoping extension element 440 or how shuttle car 420 engages the rail, staging car 450 may not be needed.

FIG. 5 is a perspective view of an embodiment of a material handling system in which rail 1000 is on the mine floor. In FIG. 5, swing arms 22 have rotated upward to allow shuttle car 20 to lower to the mine floor, and cable 73 of crane 70 is let out so that its working end is near the mine floor. At the point in time depicted, rail 1000 may be in the process of being lifted for removal or lowered for installation. In the embodiment of FIG. 5, extension element 40 comprises a single section long enough to extend the full length of rail 1000.

Figure 6:
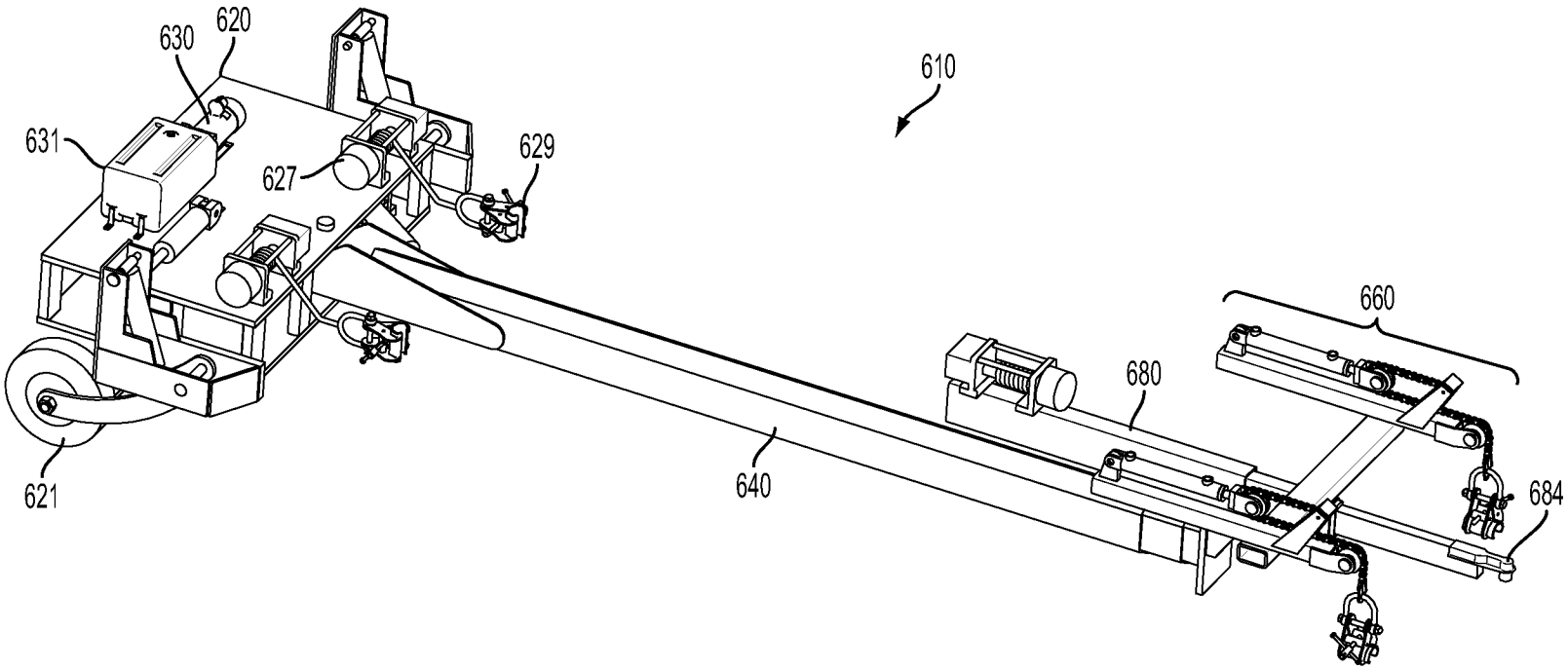
FIG. 6 is a perspective view of another embodiment of a material handling system.

FIG. 6 is a perspective view of another embodiment of a material handling system 610. Material handling system 610 in FIG. 6 has extension element 640 and shuttle car 620 similar to previous embodiments, but also has an object manipulator 660 mounted on the end of extension element 640 opposite to that of shuttle car 620. In addition to object manipulator 660, material handling system 610 has a second extension element 680 mounted to the end of extension element 640 opposite to that of shuttle car 620. The exposed end of second extension element 680 has an anchor 684 attached to it to fix that end of material handling system 610 in position when material handling system 610 is in use. In the embodiment shown in FIG. 6 anchor 684 is a ball hitch which may couple with a second coupler to hold that end of material handling system 610 in position.

Once anchor 684 is fixed in position, extension element 640 can be extended and retracted to move shuttle car 620 back and forth with respect to the opposite, fixed end of extension element 640. In FIG. 6, extension element 640 is nearly completely retracted and shuttle car 620 is at the closest it will be with the opposite end of extension element 640. When anchor 684 is fixed in position, and second extension element 680 is extended and retracted, shuttle car 620 and extension element 640 are moved back and forth with respect to anchor 684. Some embodiments of material handling system 610 will have a controls interlock that prevents extension element 640 from extending or retracting while second extension element 680 is extending or retracting. This causes shuttle car 620 and extension element 640 to move as a single body.

Figure 7:
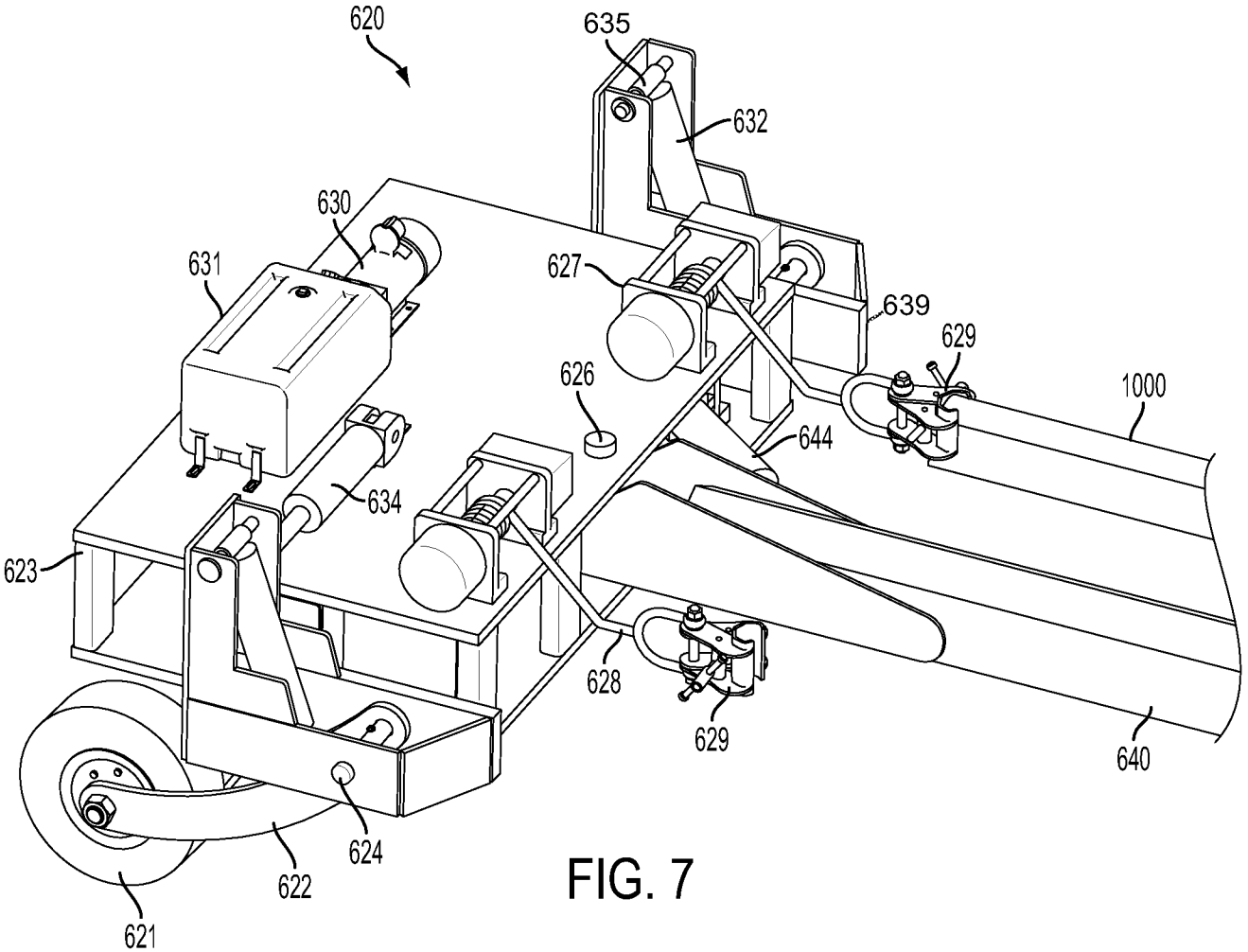
FIG. 7 is a perspective view of an embodiment of a shuttle car.

FIG. 7 is a perspective view of an embodiment of shuttle car 620. In FIG. 7, extension element is coupled to shuttle car 620 at pivot 626. Actuator 644 is coupled between extension element 640 and shuttle car 620 and can vary the relative angle between the two. This allows shuttle car 620 to be steered as it is moved back and forth by extension element 640 or second extension element 680. In the embodiment of FIG. 7, pivot 626 is essentially vertical, or perpendicular to shuttle car 620 and extension element 640. This means that shuttle car 620 and extension element 640 rotate within the same plane as actuator 644 changes the relative angle between them. Other embodiments may employ a pivot at an angle to produce a skew as the angle between shuttle car 620 and extension element 640 is varied. However, as pivot 626 approaches a horizontal orientation, the steering affect would decrease to zero.

Object manipulators 627 are mounted on the top of shuttle car 620. In the embodiment of FIG. 7, object manipulators 627 are winches with tensile members 628, which may be cables or other tensile type elements. Grapples 629 are affixed to the ends of tensile members 628 and are capable of coupling to an object to be moved or manipulated. In the embodiment shown in FIG. 7, a grapple 629 is engaged with a rail 1000. Object manipulators 627 can raise, lower, hold suspended, or pull an object.

At opposing sides of shuttle car 620, wheels 621 are mounted at the ends of swing arms 622. Swing arms 622 attach to frame 623 of shuttle car 620 at frame pivots 624. Vertical adjustment actuator 632 is coupled between swing arm 622 and frame 623 and moves swing arm 622 with respect to frame 623. In the embodiment of FIG. 7, actuators 632 are hydraulically powered. Pump 630 provides the hydraulic power for actuators 632 and fluid reservoir 631 serves as the reservoir for the hydraulic system of shuttle car 620. Batteries within shuttle car 620 are the source of power for material handling system 610. The batteries may power some elements of material handling system 610 directly, such as object manipulators 627 (when they are electric winches), or indirectly by powering pump 630 which develops hydraulic power for actuators powered in that fashion. Additionally, extension element 640 may be actuated by hydraulic actuators power by pump 630 or by electrical actuators powered directly by the batteries.

Figure 8:
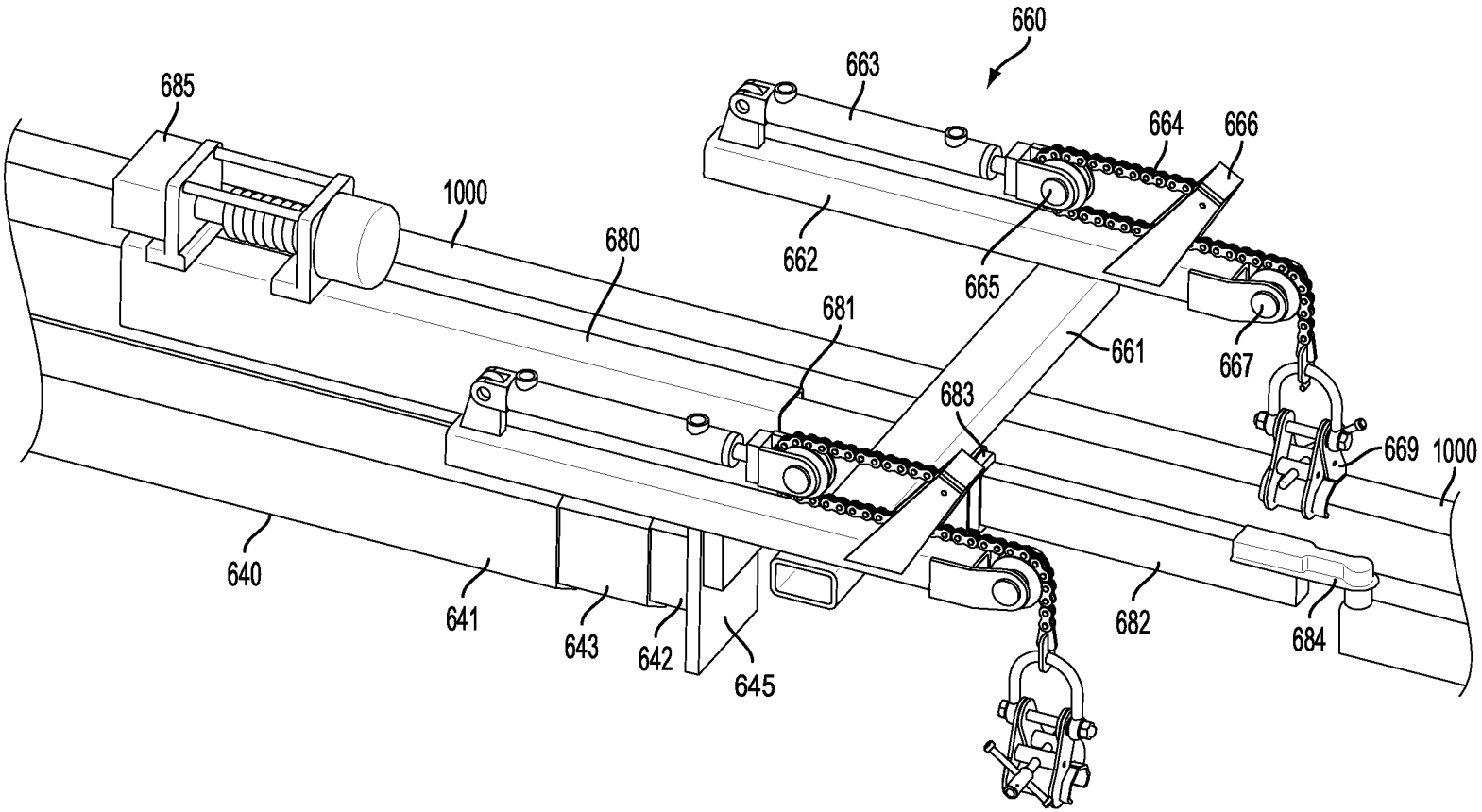
FIG. 8 is a perspective view of the material handling system at the opposite end from the shuttle car.

FIG. 8 is a perspective view of material handling system 610 at the opposite end from shuttle car 620 where a second extension element 680 is mounted to extension element 640 along with object manipulator 660. In FIG. 8, the outer sleeve 681 of second extension element 680 mounts to plate 645 at the end of section 642 of extension element 640. Internal sleeve 683 fits within outer sleeve 681 and rod 682 fits within internal sleeve 683. Anchor 684 is mounted to the end of rod 682, and in the embodiment shown in FIG. 8, anchor 684 is part of a ball hitch. When second extension element 680 extends and retracts rod 682 with respect to outer sleeve 681, the rest of material handling system 610 is moved back and forth with respect to the point at which anchor 684 is fixed. Second extension element 680 can be actuated by actuators internal to outer sleeve 681 and inner sleeve 683. These actuators may be any of several types of hydraulically or electrically powered actuators.

Cross bar 661 of object manipulator 660 is mounted to internal sleeve 683 of second extension element 680. Actuator mounts 662 are fixed to each end of cross bar 661 and support actuators 663 which are fixed at their base at one end. Opposite to the fixed bases of actuators 663 are rods carrying pulleys 665 in engagement with tensile members 664. Tensile members 664 are fixed at one end to brackets 666, pass around pulleys 665, and reverse direction to pass over pulleys 667 at the front ends of actuator mounts to drop vertically. Grapples 669 affix to the ends of tensile members 664. In the embodiment of object manipulator 660 shown in FIG. 8, tensile members 664 are chains. However, pulleys 665 do not have teeth. Grapples 669 are adapted to couple to rails such as rail 1000 in FIG. 8.

Auxiliary object manipulator 685 is mounted to the top of external sleeve 681 of second extension element 680. Auxiliary object manipulator 685 provides the capability to retrieve objects that are located laterally from material handling system 610. This is particularly useful when material handling system 610 is being used to retrieve objects in an area as opposed to unloading objects from a supply proximal to material handling system 610.

Figure 9:
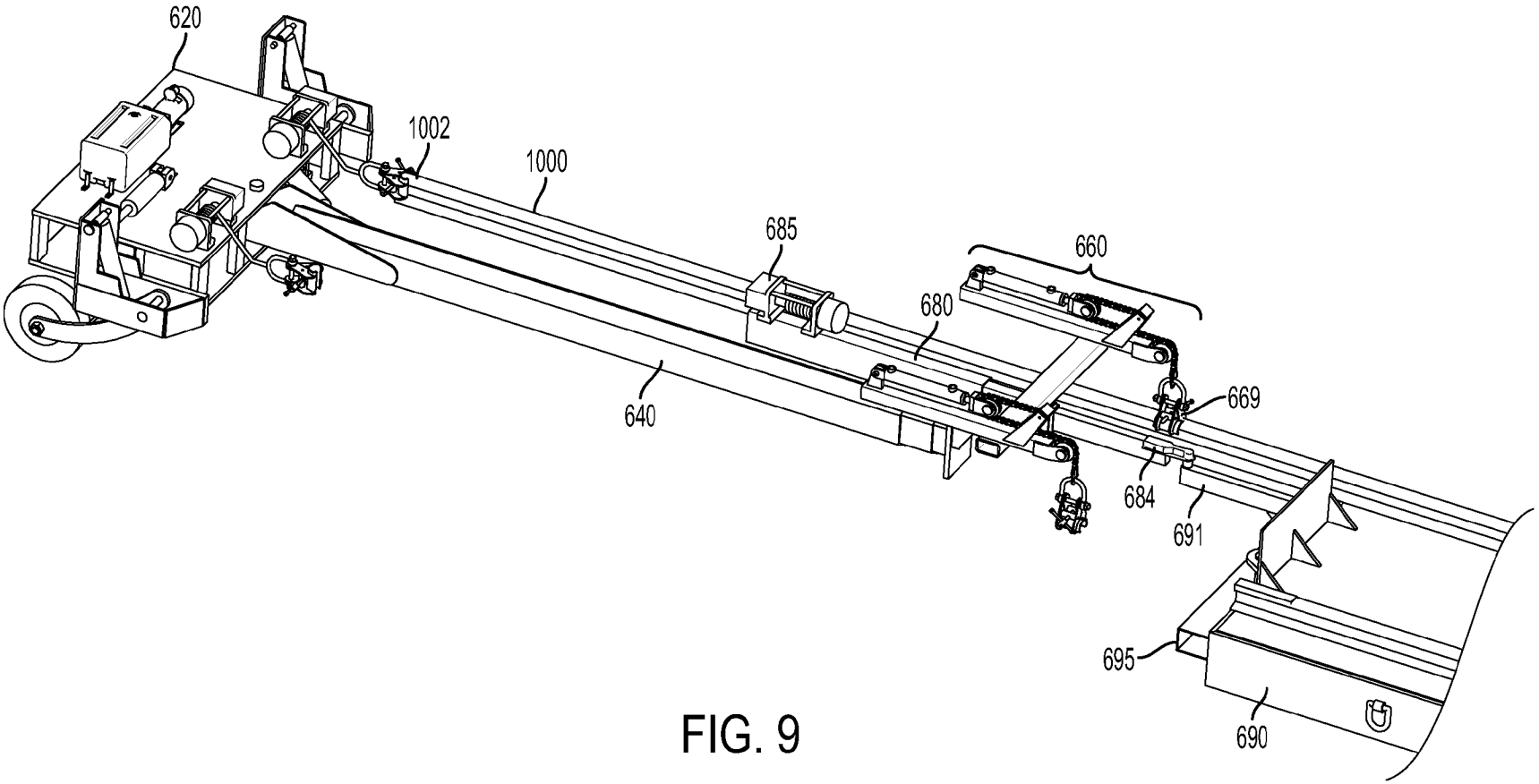
FIG. 9 is a perspective view of an embodiment of the material handling system incorporating a supply car with the material handling system in a partially retracted position.

FIG. 9 is a perspective view of an embodiment of material handling system 610 incorporating a supply car with material handling system 610 in a partially retracted position. The objects on the supply car in FIG. 9 are rails. However, material handling system 610 would be equally adept at unloading and loading other objects such as pipes, roof supports, etc. In FIG. 9, supply car 690 has coupler 691 complimentary to anchor 684 to which it is coupled and supply car 690 serves to anchor, or fix, the entire system. At least one embodiment of supply car 690 has wheels adapted and spaced to ride on a rail system.

In FIG. 9, extension element 640 is fully retracted. Rail 1000 is supported at one end 1002 by shuttle car 620 and the other end is supported on supply car 690. Second extension element 680 is at least partially extended, placing object manipulator 660 out from supply car 690.

Figure 10:
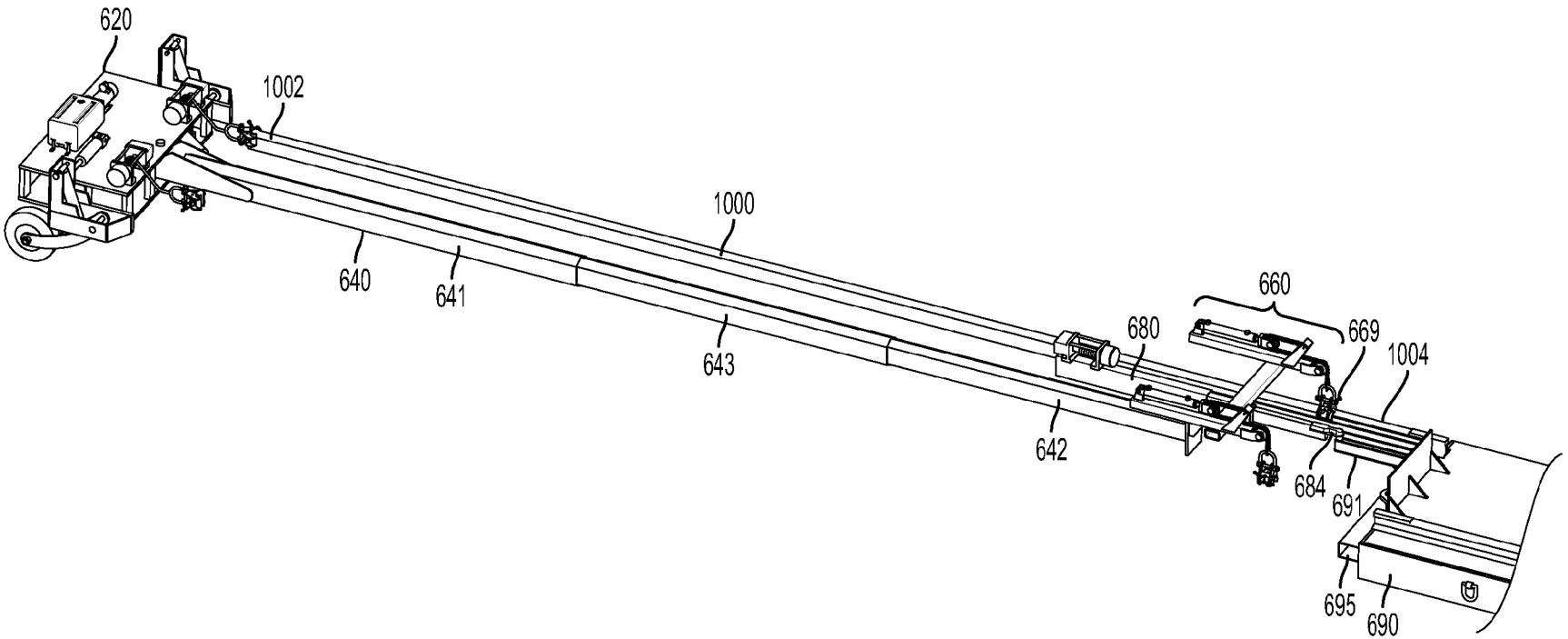
FIG. 10 is a perspective view of an embodiment of the material handling system incorporating a material supply car with the material handling system in a nearly fully extended position.

FIG. 10 is a perspective view of an embodiment of material handling system 610 incorporating supply car 690 with material handling system 610 in a nearly fully extended position. Sections 641, 642, and 643 of extension element 640 are extended to support rail 1000 at full length. Grapple 669 of object manipulator 660 is engaged with rail 1000 and end 1004 of rail 1000 is resting on supply car 690 or held above supply car 690 by object manipulator 600. If second extension element 680 extends further, shuttle car 620, extension element 640, object manipulator 660, and rail 1000 will move away from supply car 690 and end 1004 of rail 1000 will be moved clear of supply car 690. If second extension element 680 retracts, shuttle car 620, extension element 640, object manipulator 660, and rail 1000 will move toward supply car 690 and end 1004 of rail 1000 will be moved further onto supply car 690.

Figure 11:
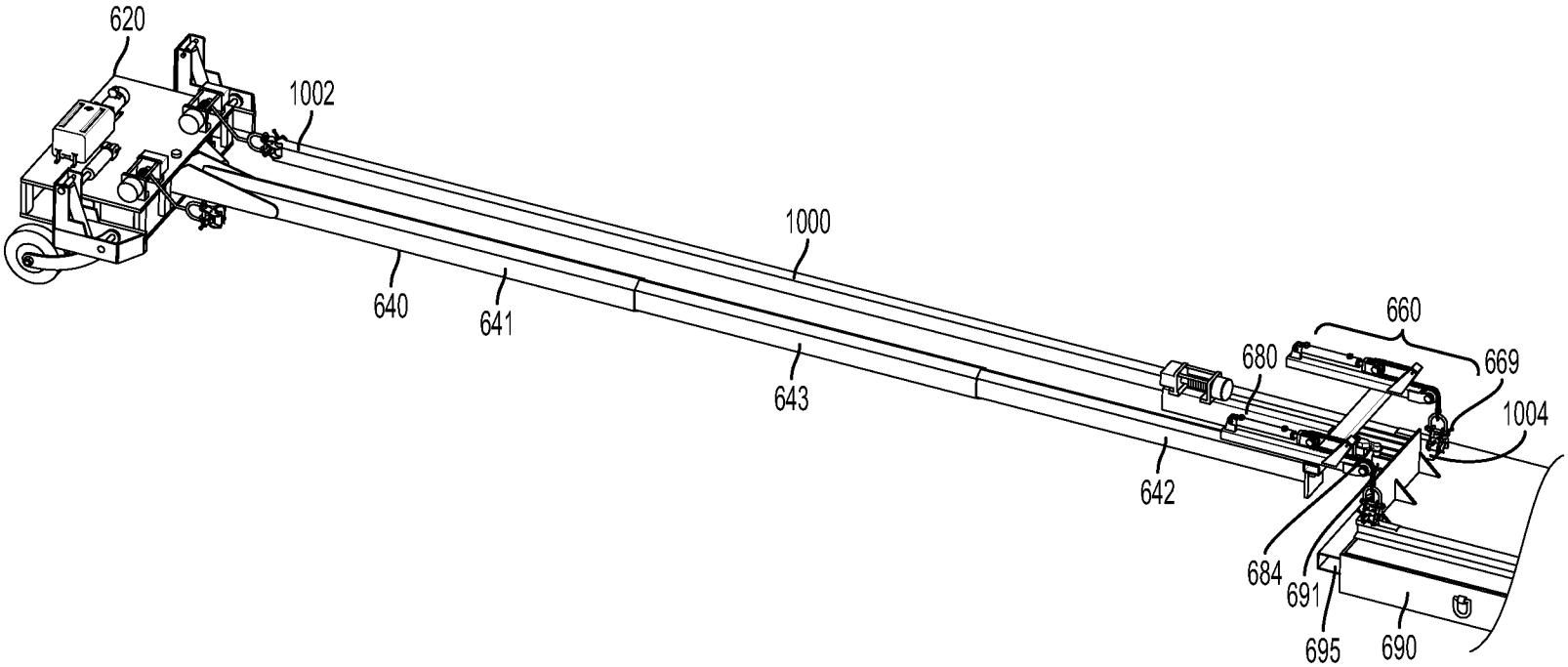
FIG. 11 is a perspective view of an embodiment of the material handling system incorporating a material supply car with the material handling system in a mostly extended position.

FIG. 11 is a perspective view of an embodiment of material handling system 610 incorporating material supply car 690 with material handling system 610 in a mostly extended position. In FIG. 11, extension element 640 is fully extended. However, second extension element 680 is fully retracted which moves shuttle car 620, extension element 640, rail 1000, and object manipulator 660 toward supply car 690. In FIG. 11, grapples 669 are past the edge of supply car 690 and over its top surface. This allows grapple 669 of object manipulator 660 to engage rail 1000 in close proximity to end 1004 of rail 1000 while it is on supply car 690.

In the embodiments of material handling system 610 shown in FIGS. 9-11, supply car 690 has switch plate 695 at its edge proximal to where anchor 684 engages with coupler 691. Switch plate 695 is a safety feature and is slightly lower than the top surface of supply car 690. If an object, such as rail 1000 is pulled off of the top surface of supply car 690 so that it contacts switch plate 695, material handling system 610 will cease to pull the object from supply car 690. Remedial action may be taken by engaging grappler 669 with the object and lifting it, etc.

Figure 12:
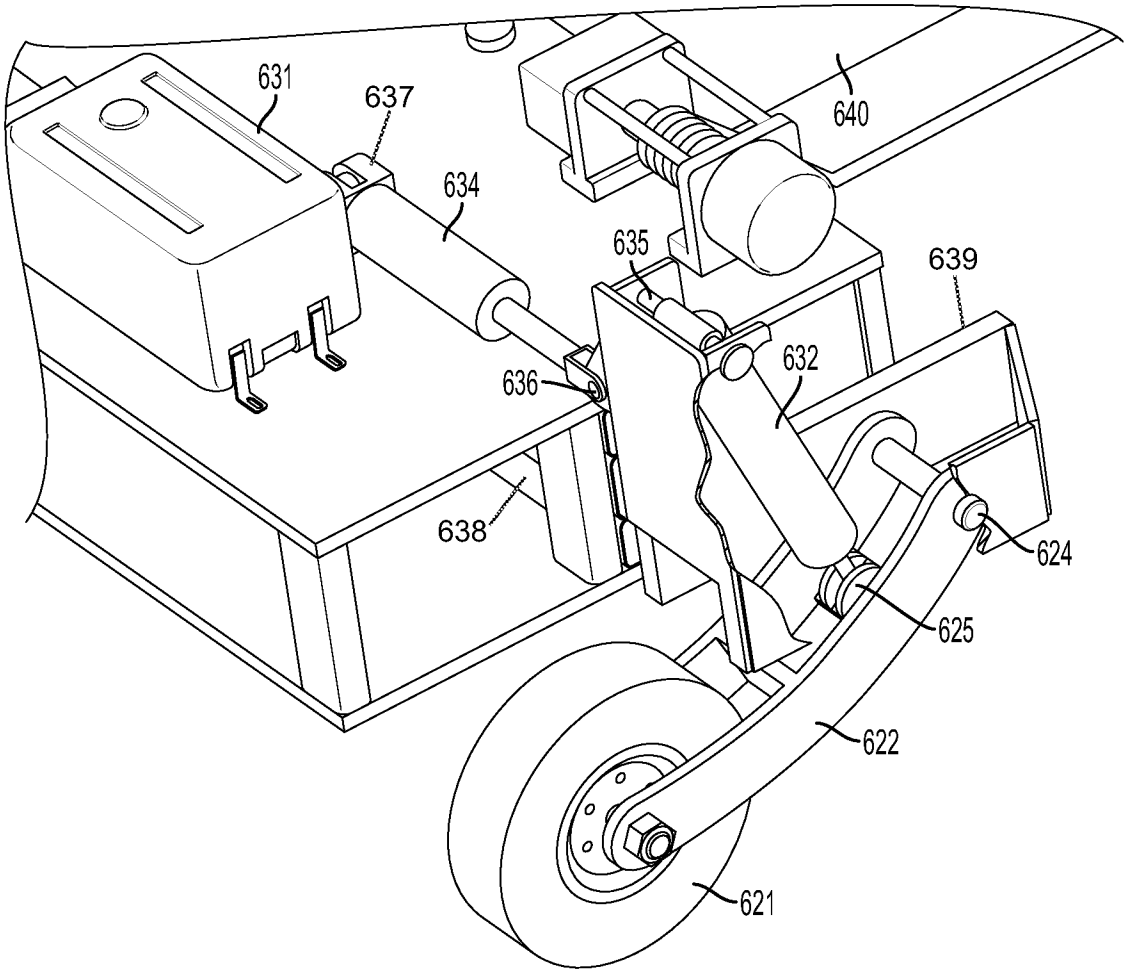
FIG. 12 is a rear perspective view of a shuttle car.

FIG. 12 is a rear perspective view of shuttle car 620 and shows mechanisms for finer adjustment of the position of shuttle car 620. Wheel 621 is mounted in swing arm 622 which pivots about frame pivot 624. Vertical adjustment actuator 632 couples to swing arm 621 at drive pivot 625 and is fixed at ground pivot 635. When vertical adjustment actuator 632 extends, it drives swing arm 622 counterclockwise about frame pivot 624 which lifts the rest of shuttle car 620. When vertical adjustment actuator 632 retracts, swing arm 622 turns clockwise about frame pivot 624 which lowers the rest of shuttle car 620.

In the embodiment of shuttle car 620 shown in FIG. 12, swing arm 622 and vertical adjustment actuator 632 are mounted to wheel plate 639. Wheel plate 639 is fixed to cross beam 638 which passes through the body of shuttle car 620 to the opposite side of shuttle car 620 where a complementary wheel plate and wheel assembly are fixed to the other end of cross beam 638. Frame 623 of shuttle car 620 can slide along cross beam 638. Horizontal adjustment actuator 634 is coupled to wheel plate 639 at pivot 636 and to shuttle car frame 623 at pivot 637. Horizontal adjustment actuator 634 can move frame 623 back and forth along cross beam 638 between wheel plates 639 to horizontally adjust the position of frame 623.

The various moving elements of the several embodiments discussed may be powered by any common power source. For example, the shuttle car can raise and lower its wheels and steer by hydraulic cylinders which are powered by a motor and hydraulic pump. Similarly, for embodiments of the extension element that are telescoping extension elements, they may be powered by one or more hydraulic cylinders. However, other linear actuators such as lead screws driven by electric motors may be employed as well may be cable arrangements in some embodiments. The rail lowering mechanism and rail manipulator may be hydraulically powered or may be electrically power. For example, a winch will likely be electrically driven, while a crane will likely be at least partially electrically driven. Movement of the trolley on which a rail manipulator rides may be accomplished by a cylinder, particularly a hydraulic cylinder, or by a cable or chain loop driven hydraulically or electrically.

In addition to variation among types of extension elements, motive units, rail lowering mechanisms, and rail manipulators, embodiments of the material handling system may vary by the number of cars employed. Some embodiments may employ a shuttle car attached to a staging car by an extension element, wherein a supply car is interchangeably connected to the staging car. As one supply car is emptied, or filled, it may be disconnected to make room for another supply car. In this embodiment, several supply cars with minor or no modification could service the slowly moving jobsite where the shuttle car, extension element, and staging car combination are located. Other embodiments may employ a shuttle car attached directly to a supply car by an extension element. While this embodiment is simpler, it does not have the advantage of changing out the car that carries the supply of objects.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

I claim:

1. A material handling system comprising:

a first extension element having a first end and a second end, said extension element capable of extending and retracting between a first position where said first end and said second end are closest to each other and a second position where said first end and said second end are farthest from each other;

a first car coupled to said first end of said first extension element, said first car comprising a frame and wheels mounted to said frame;

a steering mechanism for steering said first car as said first extension element extends and retracts, said steering mechanism comprising, a non-horizontal pivot coupling said first car to said first end of said extension element; and, an actuator coupled to said extension element and said first car, said actuator controlling the angle between said extension element and said first car;

a first object manipulator, said first object manipulator being capable of coupling to objects and moving said objects; and an anchor fixing said second end of said first extension element in place.

2. The material handling system of claim 1, wherein:

said first car is capable of raising and lowering said frame by changing the positions of said wheels with respect to said frame.

3. The material handling system of claim 1, wherein:

said first object manipulator is a winch.

4. The material handling system of claim 1, wherein:

said first object manipulator is mounted on said first car.

5. The material handling system of claim 1, further comprising:

a second object manipulator.

6. The material handling system of claim 5, wherein:

said second object manipulator is mounted on said second end of said first extension element.

7. The material handling system of claim 1, further comprising:

a second extension element, said second extension element being mounted on said second end of said first extension element, said anchor being mounted on said second extension element.

8. The material handling system of claim 5, wherein:

said anchor comprises a first coupler; and said material handling system comprises a second car, said second car having a second coupler, said second coupler formed and positioned to couple with said first coupler.

9. The material handling system of claim 8, wherein:

said second object manipulator is mounted on said second car.

10. The material handling system of claim 9, further comprising:

a track on said second car; and a trolley riding on said track;

said second object manipulator being mounted on said trolley; and said second coupler being mounted to said trolley.

11. The material handling system of claim 1, further comprising;

a second car in proximity to said second end of said first extension element, said second car comprising a switch plate proximal to the edge of said second car nearest to said second coupler.

12. A material handling system comprising;

a first extension element having a first end and a second end, said extension element capable of extending and retracting between a first position where said first end and said second end are closest to each other and a second position where said first end and said second end are farthest from each other;

a first car coupled to said first end of said first extension element, said first car comprising a frame and wheels mounted to said frame;

a steering mechanism for steering said first car as said first extension element extends and retracts;

a first object manipulator, said first object manipulator being capable of coupling to objects and moving said objects;

an anchor fixing said second end of said first extension element in place;

a cross beam passing horizontally through said frame between said wheels, said wheels being mounted to said cross beam, said frame movable along said cross beam; and a horizontal adjustment actuator coupled between said frame and said cross beam;

wherein said horizontal adjustment actuator adjusts the position of said frame on said cross beam.

13. A rail handling system comprising:

a first extension element having a first end and a second end, said extension element capable of extending and retracting between a first position where said first end and said second end are closest to each other and a second position where said first end and said second end are farthest from each other;

a first car coupled to said first end of said first extension element, said first car comprising a frame and wheels mounted to said frame;

a steering mechanism for steering said first car as said first extension element extends and retracts, said steering mechanism comprising, a non-horizontal pivot coupling said first car to said first end of said extension element; and, an actuator coupled to said extension element and said first car, said actuator controlling the angle between said extension element and said first car;

a first rail manipulator, said first rail manipulator being capable of coupling to a rail and moving said rail; and a first coupler mounted on said second end of said first extension element.

14. The rail handling system of claim 13, wherein:

said first car is capable of raising and lowering said frame by changing the positions of said wheels with respect to said frame.

15. The rail handling system of claim 13, wherein:

said first rail manipulator is a winch.

16. The rail handling system of claim 13, wherein:

said first rail manipulator is mounted on said first car.

17. The rail handling system of claim 13, further comprising:

a second rail manipulator.

18. The rail handling system of claim 17, wherein:

said second rail manipulator is mounted on said second end of said first extension element.

19. The rail handling system of claim 13, further comprising:

a second extension element, said second extension element being mounted on said second end of said first extension element, said first coupler being mounted on said second extension element.

20. The rail handling system of claim 17, further comprising:

a second car, said second car having a second coupler, said second coupler formed and positioned to couple with said first coupler.

21. The rail handling system of claim 20, wherein:

said second rail manipulator is mounted on said second car.

22. The rail handling system of claim 21, further comprising:

a track on said second car; and a trolley riding on said track;

said second rail manipulator being mounted on said trolley; and said second coupler being mounted to said trolley.

23. The rail handling system of claim 13, further comprising;

a second car, said second car having a second coupler, said second coupler formed and positioned to couple with said first coupler, said coupling further comprising a switch plate proximal to the edge of said second car nearest to said second coupler.

24. The rail handling system of claim 13, further comprising;

a first extension element having a first end and a second end, said extension element capable of extending and retracting between a first position where said first end and said second end are closest to each other and a second position where said first end and said second end are farthest from each other;

a first car coupled to said first end of said first extension element, said first car comprising a frame and wheels mounted to said frame;

a steering mechanism for steering said first car as said first extension element extends and retracts;

a first rail manipulator, said first rail manipulator being capable of coupling to a rail and moving said rail; and a first coupler mounted on said second end of said first extension element;

a cross beam passing horizontally through said frame between said wheels, said wheels being mounted to said cross beam, said frame movable along said cross beam; and a horizontal adjustment actuator coupled between said frame and said cross beam;

wherein horizontal adjustment actuator adjusts the position of said frame on said cross beam.

* * * * *